US008807959B2

(12) United States Patent
Grant et al.

(10) Patent No.: US 8,807,959 B2
(45) Date of Patent: Aug. 19, 2014

(54) RECIPROCATING COMPRESSOR AND METHODS FOR MONITORING OPERATION OF SAME

(75) Inventors: John Wesley Grant, Gardnerville, NV (US); Brian Francis Howard, Issaquah, WA (US)

(73) Assignee: General Electric Company, Schenectady, NY (US)

( * ) Notice: Subject to any disclaimer, the term of this patent is extended or adjusted under 35 U.S.C. 154(b) by 693 days.

(21) Appl. No.: 12/955,987

(22) Filed: Nov. 30, 2010

(65) Prior Publication Data

US 2012/0134850 A1 May 31, 2012

(51) Int. Cl.
*F04B 49/00* (2006.01)

(52) U.S. Cl.
USPC ..... 417/63; 73/168; 702/56; 340/540

(58) Field of Classification Search
CPC ..... F04B 2203/0406; F04B 2203/0206; F04B 2203/0602
USPC ..... 417/63, 44.1; 73/168, 702; 702/54, 56, 702/98, 138, 1, 33, 34, 41, 43, 42, 44, 127, 702/140, 182; 340/500, 540, 679
See application file for complete search history.

(56) References Cited

U.S. PATENT DOCUMENTS 4,456,963 A 6/1984 Wiggins
5,846,056 A * 12/1998 Dhindsa et al. ..... 417/44.2
6,260,004 B1 * 7/2001 Hays et al. ..... 702/183
6,260,532 B1 7/2001 Mendler
6,292,757 B1 * 9/2001 Flanagan et al. ..... 702/138
6,302,654 B1 * 10/2001 Millet et al. ..... 417/63
6,567,709 B1 * 5/2003 Malm et al. ..... 700/21
6,882,960 B2 * 4/2005 Miller ..... 702/182
7,030,746 B2 * 4/2006 Littrell et al. ..... 340/500
7,056,097 B2 * 6/2006 Lake ..... 417/63
7,308,322 B1 * 12/2007 Discenzo et al. ..... 700/28
7,318,350 B2 1/2008 Boken
7,403,850 B1 * 7/2008 Boutin et al. ..... 701/107
7,418,355 B2 * 8/2008 Grant et al. ..... 702/56
7,542,875 B2 * 6/2009 Rogers ..... 702/183
7,581,449 B2 * 9/2009 Miller ..... 73/744
7,623,986 B2 * 11/2009 Miller ..... 702/182
7,693,684 B2 * 4/2010 Halbinger et al. ..... 702/182

(Continued)

OTHER PUBLICATIONS

Leonard, Stephen M. "Increasing the Reliability of Reciprocating Compressor on Hydrogen Service," 13 pages, Hydrocarbon Processing, Jan. 1996.

(Continued)

*Primary Examiner* — Nathan Zollinger
(74) *Attorney, Agent, or Firm* — Fletcher Yoder, P.C.

(57) ABSTRACT

A condition monitoring system for use with a reciprocating device. The condition monitoring system includes at least one pressure sensor that is configured to sense a pressure within the reciprocating device. At least one vibration sensor is configured to sense a vibration of the reciprocating device. A protection system is communicatively coupled to the pressure sensor and the vibration sensor. The protection system is configured to calculate a stiffness value of the reciprocating device based on the sensed pressure within the reciprocating device and the sensed vibration of the reciprocating device.

20 Claims, 8 Drawing Sheets

(56) References Cited

U.S. PATENT DOCUMENTS

| | | | | |
|---|---|---|---|---|
| 8,147,211 | B2 * | 4/2012 | Grant et al. | 417/63 |
| 2004/0213677 | A1 * | 10/2004 | Matzner et al. | 417/63 |
| 2007/0151342 | A1 * | 7/2007 | Grant et al. | 73/593 |
| 2010/0082275 | A1 * | 4/2010 | Borsting et al. | 702/56 |
| 2010/0101785 | A1 * | 4/2010 | Khvoshchev et al. | 166/250.01 |
| 2010/0176591 | A1 | 7/2010 | Clucas | |
| 2012/0100011 | A1 * | 4/2012 | Sommer et al. | 417/44.1 |

OTHER PUBLICATIONS

Sijm, Albert et al., "Improving Reliability for Recips," Orbit, p. 32-35, vol. 1, 2004.

Howes, Brian et al., "Cylinder Stretch as Source of Vibration in Reciprocating Compressors," presented at the Mechanical Failure Prevention Group Meeting, p. 1-10, Apr. 11, 1991, Annapolis, MD.

* cited by examiner

RECIPROCATING COMPRESSOR AND METHODS FOR MONITORING OPERATION OF SAME

BACKGROUND OF THE INVENTION

This invention relates generally to reciprocating compressors and, more particularly, to methods and systems for use in monitoring operation of reciprocating compressors.

At least some known reciprocating compressors include a cylinder assembly that is coupled to a compressor frame and that includes a piston assembly that moves in a reciprocating motion within a cylinder head. Known piston assemblies compress a gas channeled within the cylinder head prior to discharging compressed gas to an output device.

At least some known reciprocating components in known compressors may be subjected to increased loads (e.g., asymmetric loads) that result from structural fatigue. Over time, the increased loading may contribute to increasing fatigue cycles on the cylinder assembly and/or other components of the reciprocating compressor, and may lead to premature failure of such components. Moreover, components that have not been properly installed may become loose during operation. In addition, known reciprocating compressors may be subjected to operational detriments from operating conditions, such as modulating pressure, vibrations, modulating temperatures, and general mechanical wear. The combination of the operational detriments and the increasing loading may induce stresses to the compressor that cause structural fatigue and/or failure, which may adversely impact performance of the reciprocating compressor.

At least some known methods for monitoring known reciprocating compressors require manual inspections of the compressor and associated components. Such inspections may be expensive and/or time-consuming.

BRIEF DESCRIPTION OF THE INVENTION

In one aspect, a condition monitoring system for use with a reciprocating device is provided. The condition monitoring system includes at least one pressure sensor that is configured to sense a pressure within the reciprocating device. At least one vibration sensor is configured to sense a vibration of the reciprocating device. A protection system is communicatively coupled to the pressure sensor and the vibration sensor. The protection system is configured to calculate a stiffness value of the reciprocating device based on the sensed pressure within the reciprocating device and the sensed vibration of the reciprocating device.

In another aspect, a reciprocating compressor is provided. The reciprocating compressor includes a compressor frame, a crank shaft that is positioned within the compressor frame, and a cylinder assembly that is coupled to the compressor frame and to the crank shaft. The cylinder assembly extends outwardly from the compressor frame along a centerline axis. At least one pressure sensor is configured to sense a pressure within the reciprocating compressor. At least one vibration sensor is configured to sense a vibration of the reciprocating compressor. A protection system is communicatively coupled to the pressure sensor and the vibration sensor. The protection system is configured to calculate a stiffness value of the reciprocating compressor based on the sensed pressure within the reciprocating compressor and the sensed vibration of the reciprocating compressor.

In yet another aspect, a method for monitoring a condition of a reciprocating compressor is provided. The reciprocating compressor includes a cylinder assembly that is coupled to a frame. The method includes transmitting, from a first sensor to a protection system, a first monitoring signal indicative of a pressure within the cylinder assembly of the reciprocating compressor. At least a second sensor transmits at least a second monitoring signal indicative of a vibration of the cylinder assembly to the protection system. The protection system calculates a stiffness value of the reciprocating compressor based at least in part on the first signal and the second signal.

DETAILED DESCRIPTION OF THE INVENTION

The exemplary methods and systems described herein overcome disadvantages of known monitoring systems by providing a condition monitoring system that facilitates monitoring the condition of known reciprocating compressors. In addition, the condition monitoring system enables the bolted integrity of throw components of the reciprocating compressor to be determined, while the compressor remains operating, based on a stiffness of a cylinder assembly. Moreover, the condition monitoring system enables the reciprocating compressor to shut-down after determining that the condition of the reciprocating compressor is different than a predefined condition.

Figure 1:
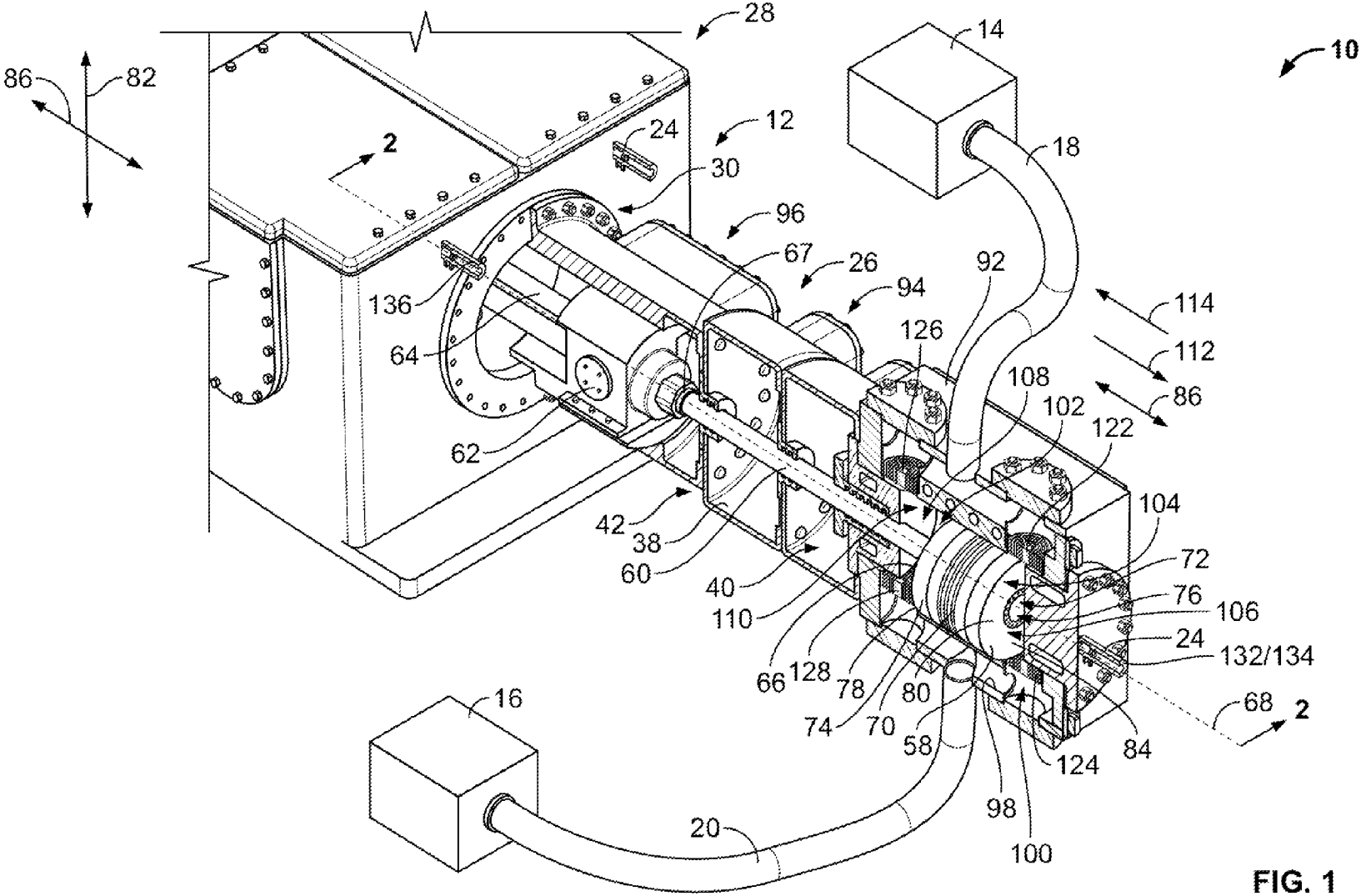
FIG. 1 is a partial perspective view of an exemplary reciprocating compressor.
Figure 2:
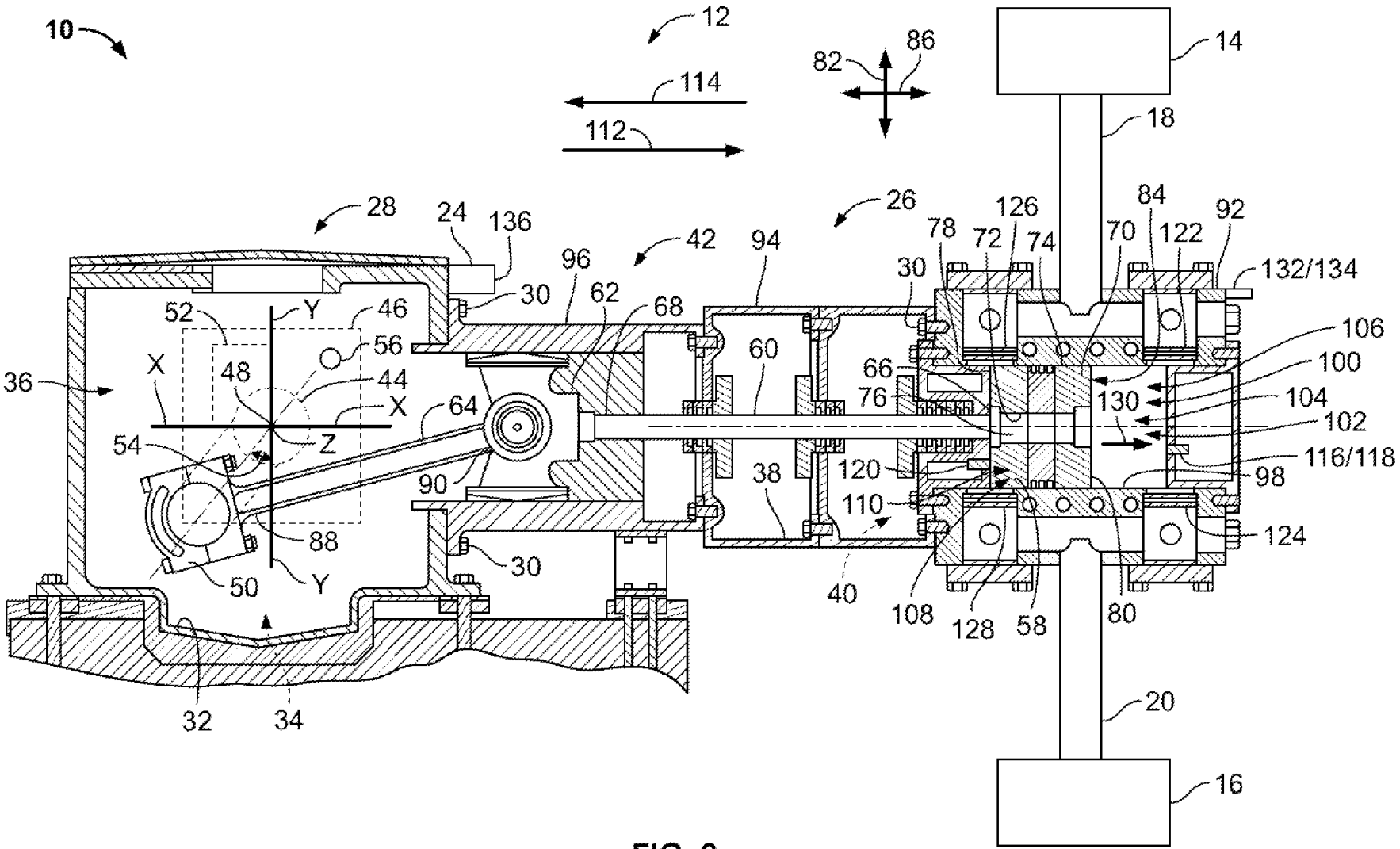
FIG. 2 is a cross-sectional view of the reciprocating compressor shown in FIG. 1 and taken along line 2-2.

FIG. 1 is a schematic illustration of an exemplary reciprocating compressor 10 including a condition monitoring system 12. FIG. 2 is a cross-sectional view of reciprocating compressor 10 taken along line 2-2. In the exemplary embodiment, reciprocating compressor 10 is coupled in flow communication between a gas source 14 and an output assembly 16. Reciprocating compressor 10 receives a flow of fluid such as, for example a gas or a gas mixture, compresses the gas to a higher pressure and a lower volume, and discharges the compressed gas to output assembly 16. In the exemplary embodiment, one or more fluid inlet conduits 18 are coupled between gas source 14 and reciprocating compressor 10 for channeling gas from gas source 14 to reciprocating compressor 10. Moreover, one or more fluid outlet conduits 20 are coupled between reciprocating compressor 10 and output assembly 16 for channeling compressed gas from reciprocating compressor 10 to output assembly 16.

In the exemplary embodiment, condition monitoring system 12 is coupled to reciprocating compressor 10 for monitoring reciprocating compressor 10. More specifically, condition monitoring system 12 is coupled to reciprocating compressor 10 to enable monitoring of a stiffness of reciprocating compressor 10. As used herein, the term "stiffness" refers to an amount of displacement of reciprocating compressor 10 with respect to an amount of force applied to reciprocating compressor 10 in a predefined direction. Condition monitoring system 12 includes a protection system 22 (not shown in FIG. 2) that is coupled in communication with a plurality of sensors 24. Each sensor 24 detects various conditions of reciprocating compressor 10. Sensors 24 may include, but are not limited to only including, position sensors, temperature sensors, flow sensors, acceleration sensors, pressure sensors and/or any other sensors that sense various parameters relative to the operation of reciprocating compressor 10. As used herein, the term "parameters" refers to physical properties whose values can be used to define the operating conditions of reciprocating compressor 10, such as vibrations, pressures, and fluid flows at defined locations.

In the exemplary embodiment, reciprocating compressor 10 includes at least one cylinder assembly 26 that is coupled to a compressor frame 28. A plurality of fastener assemblies 30 couple cylinder assembly 26 to compressor frame 28. In the exemplary embodiment, compressor frame 28 includes an inner surface 32 that defines a cavity 34 therein. A crankshaft assembly 36 coupled to compressor frame 28 is positioned within cavity 34. Cylinder assembly 26 extends outwardly from compressor frame 28 and includes an inner surface 38 that defines a cylinder cavity 40. A piston assembly 42 is positioned within cylinder cavity 40 and is coupled to crankshaft assembly 36. Crankshaft assembly 36 includes a crankshaft 44 that is rotatably coupled to a motor 46. Motor 46 is configured to rotate crankshaft 44 about an axis of rotation 48 and protection system 22 controls an operation of motor 46.

In the exemplary embodiment, crankshaft 44 includes at least one crank pin 50 that extends substantially radially outwardly from crankshaft 44. More specifically, in the exemplary embodiment, three perpendicular axes X, Y, and Z extend through crankshaft 44 to define a three-dimensional Cartesian coordinate system relative to crankshaft 44 such that the Z-axis is substantially coaxial with axis of rotation 48, and such that the X-axis and the Y-axis intersect to form a rotational plane 52 of crank pin 50. A crank angle $\alpha$ is defined between crank pin 50 and Y-axis. Crankshaft 44 is configured to rotate crank pin 50 about axis 48 between a crank angle of about 0° to about 360°. At least one position sensor 56 is coupled to compressor frame 28 for sensing a position of crank pin 50 with respect to Y-axis and for transmitting a signal indicative of the sensed position to protection system 22. In one embodiment, position sensor 56 includes a multi-event wheel for use in sensing a position of crank pin 50 with respect to Y-axis.

In the exemplary embodiment, piston assembly 42 includes a piston head 58, a piston rod 60 that is coupled to piston head 58, a crosshead 62 that is coupled to piston rod 60, and a connecting rod 64 that is coupled between crosshead 62 and crank pin 50. Piston rod 60 includes a centerline axis 68 that extends from a first end 66 to a second end 67. Piston assembly 42 is coupled to crankshaft assembly 36 such that axis or rotation 48 is oriented substantially perpendicular to centerline axis 68. Piston head 58 includes an annular piston body 70 that includes a radially inner surface 72 and a radially outer surface 74. Radially inner surface 70 defines an inner cylindrical cavity 76 that extends generally axially through piston body 70 along centerline axis 68. Inner cylindrical cavity 76 is substantially cylindrical in shape and is sized to receive piston rod 60 therein. Piston head 58 also includes a crank end surface 78 and an opposite head end surface 80. Crank end surface 78 is positioned closer to crankshaft 44 than head end surface 80. Each end surface 78 and 80 extends generally radially between radially inner surface 72 and radially outer surface 74 in a direction that is that is generally perpendicular to centerline axis 68. Each end surface 78 and 80 includes a working surface area 84 that extends between surfaces 72 and surfaces 74.

In the exemplary embodiment, piston assembly 42 translates a rotation of crankshaft 44 about axis 48 into a linear movement of piston head 58 along centerline axis 68. Piston rod 60 is coupled between crosshead 62 and piston head 58, and is oriented to move piston head 58 along centerline axis 68. Connecting rod 64 extends between crosshead 62 and crank pin 50 and includes a first end 88 and a second end 90. First end 88 is coupled to crank pin 50 and is pivotable with respect to crank pin 50, as crank pin 50 rotates about axis 48. Second end 90 is coupled to crosshead 62 and is pivotable with respect to crosshead 62. During operation, as crankshaft 44 rotates about axis 48, connecting rod 64 pivots with respect to crosshead 62 and moves crosshead 62 along centerline axis 68. Crosshead 62, in turn, moves piston rod 60 and piston head 58 longitudinally along centerline axis 68. As crankshaft 44 is rotated through a full rotation from crank angle $\alpha$ from 0° to 360°, piston head 58 is reciprocated along centerline axis 68. A complete compressor operation cycle of reciprocating compressor 10 includes a full rotation between crank angle $\alpha$ of 0° to 360°.

In the exemplary embodiment, cylinder assembly 26 includes a cylinder head 92, a distance piece 94, and a crosshead guide 96. Fastener assemblies 30 are coupled between cylinder head 92, distance piece 94, and crosshead guide 96 to facilitate coupling cylinder head 92, distance piece 94, and crosshead guide 96 together. Distance piece 94 extends between cylinder head 92 and crosshead guide 96. Crosshead guide 96 is coupled to compressor frame 28 for supporting cylinder assembly 26 from compressor frame 28. Cylinder head 92 includes an inner surface 98 that defines a cavity 100. Piston head 58 is positioned within, and is movable within, cavity 100 along centerline axis 68. Head end surface 80 at least partially defines a first chamber 104, i.e. a head end (HE) chamber that extends between head end surface 80 and inner surface 98. Crank end surface 78 defines a second chamber 108, i.e. a crank end (CE) chamber that extends between crank end surface 78 and inner surface 98. Piston rod 60 extends outwardly from piston head 58 and is positioned with distance piece 94. Crosshead 62 is coupled to piston rod 60 and is positioned within crosshead guide 96.

In the exemplary embodiment, piston assembly 42 is moveable in a reciprocating motion along centerline axis 68 between a compression stroke, represented by arrow 112, and a tension stroke, represented by arrow 114. During compression stroke 112, piston head 58 moves outwardly from crankshaft 44 such that HE chamber 104, i.e. a HE volume, is reduced and such that chamber 108, i.e. a CE volume, is increased. During tension stroke 114, piston head 58 moves inwardly towards crankshaft 44 such that the HE chamber volume is increased and such that CE chamber volume is reduced. At least one pressure sensor 116 is coupled to cylinder assembly 26 for use in sensing a pressure within HE chamber 104 and/or CE chamber 108. Pressure sensor 116 transmits a signal indicative of fluid pressure to protection system 22. In the exemplary embodiment, condition monitoring system 12 includes a first pressure sensor 118 and a second pressure sensor 120. First pressure sensor 118 is coupled to HE chamber 104 for sensing a pressure within HE chamber 104, and second pressure sensor 120 is coupled to CE chamber 108 for sensing a pressure within CE chamber 108.

In the exemplary embodiment, cylinder head 92 includes an HE suction valve 122 and a HE discharge valve 124. HE suction valve 122 is coupled in flow communication between HE chamber 104 and fluid inlet conduit 18 for regulating a flow of gas from gas source 14 to HE chamber 104. HE suction valve 122 is movable between an open position that enables gas to be channeled from gas source 14 to HE chamber 104, and a closed position that prevents gas from being channeled from gas source 14 to HE chamber 104. HE discharge valve 124 is coupled in flow communication between HE chamber 104 and fluid outlet conduit 20 for regulating a flow of compressed gas from HE chamber 104 to output assembly 16. HE discharge valve 124 is movable between an open position that enables gas to be discharged from HE chamber 104 to output assembly 16 and a closed position that prevents gas from being discharged from HE chamber 104 to output assembly 16. HE suction valve 122 moves to the open position when a pressure within HE chamber 104 is at a first predefined pressure, and to move to the closed position when the pressure within HE chamber 104 is above the first pressure. HE discharge valve moves to the open position when the pressure within HE chamber is at a second predefined pressure that is higher than the first pressure, and to move to the closed position when the pressure is below the second pressure.

Cylinder head 92 also includes a CE suction valve 126 and a CE discharge valve 128. CE suction valve 126 is coupled in flow communication between CE chamber 108 and fluid inlet conduit 18 for regulating a flow of gas from gas source 14 to CE chamber 108. CE suction valve 126 is movable between an open position that enables gas to be channeled from gas source 14 to CE chamber 108 and a closed position that prevents gas from being channeled from gas source 14 to CE chamber 108. CE discharge valve 128 is coupled in flow communication between CE chamber 108 and fluid outlet conduit 20 for regulating a flow of compressed gas from CE chamber 108 to output assembly 16. CE discharge valve 128 is movable between an open position that enables gas to be discharged from CE chamber 108 to output assembly 16 and a closed position that prevents gas from being discharged from CE chamber 108 to output assembly 16. CE suction valve 126 moves to the open position when a pressure within CE chamber 108 is at a third predefined pressure, and to move to the closed position when the pressure within CE chamber 108 is above the third pressure. CE discharge valve 128 moves to the open position when the pressure within CE chamber 108 is at a fourth predefined pressure that is greater than the third pressure, and to move to the closed position when the pressure within CE chamber 108 is below the fourth pressure.

During operation of reciprocating compressor 10, HE suction valve 122 and HE discharge valve 124 are operated to maintain a pressure within HE chamber 104 between the first and second pressures. As piston assembly 42 moves through tension stroke 114, HE suction valve 122 and HE discharge valve are closed such that pressure within HE chamber 104 is reduced from the second pressure to the first pressure as the HE chamber volume is increased. At the first pressure, HE suction valve 122 moves to the open position to enable a flow of gas to be channeled into HE chamber 104 from gas source 14. As gas is channeled into HE chamber 104, piston assembly 42 moves through tension stroke 114 towards a first rod reversal event. During the first rod reversal event, piston assembly 42 reverses direction along centerline axis 68 from tension stroke 114 to compression stroke 112. During compression stroke 112, pressure within HE chamber 104 is increased from the first pressure to the second pressure. As the pressure within HE chamber 104 is increased above the first pressure, HE suction valve 122 moves to the closed position to prevent gas from being channeled from gas source 14 to HE chamber 104. During compression stroke 112, the HE chamber volume is reduced to facilitate compressing gas within HE chamber 104. At second pressure, HE discharge valve 124 moves to the open position to enable compressed gas to be discharged from HE chamber 104 to output assembly 16 as piston assembly 42 moves through compression stroke 112 towards a second rod reversal event. During the second rod reversal event, piston assembly 42 reverses direction along centerline axis 68 from compression stroke 112 to tension stroke 114.

Similarly, CE suction valve 126 and CE discharge valve 128 are operated to maintain a pressure within CE chamber 108 between the third and fourth pressures. As piston assembly 42 moves through compression stroke 112, CE suction valve 126 and CE discharge valve 128 are closed such that pressure within CE chamber 108 is reduced from the fourth pressure to the third pressure. At the third pressure, CE suction valve 126 is opened to enable a flow of gas to be channeled into CE chamber 108 from gas source 14. As piston assembly 42 moves through the first rod reversal event to tension stroke 114, pressure within CE chamber 108 is increased from the third pressure to the fourth pressure. As the pressure within CE chamber 108 is increased above the third pressure, CE suction valve 126 is closed to prevent gas from being channeled from gas source 14 to CE chamber 108, and to enable piston head 58 to compress gas within CE chamber 108. At fourth pressure, CE discharge valve 128 is opened to enable compressed gas to be discharged from CE chamber 108 to output assembly 16 as piston assembly 42 moves towards the second rod reversal event.

Moreover, during operation of reciprocating compressor 10, as piston head 58 compresses gas within HE chamber 104, the compressed gas imparts a gas force, represented by arrow 130, against cylinder head 92. As used herein, the term "gas force" refers to an amount of force applied against cylinder head 92 by gas when piston head 58 is compressing the gas within HE chamber 104 and/or CE chamber 108. Gas force 130 acting upon cylinder head 92 is approximately equal to the sum of the gas force acting upon crank end surface 78 of piston head 58 and the gas force acting upon the head end surface 80 of piston head 58. The gas force acting on the head end surface 80 is approximately equal to working surface area 84 of head end surface 80 multiplied by the pressure within HE chamber 104. The gas force acting upon crank end surface 78 of piston head 58 is equal to working surface area 84 of crank end surface 78 multiplied by the pressure within CE chamber 108.

During operation, reciprocating compressor 10, cylinder assembly 26 and compressor frame 28 are subjected to various forces, i.e. gas compression loads and/or rotational loads that cause cylinder assembly 26 and compressor frame 28 to oscillate and/or generate a vibration. More specifically, as piston assembly 42 is moved through a compression stroke 112 and a tension stroke 114, cylinder assembly 26 and compressor frame 28 oscillate along centerline axis 68. Over time, the oscillations and/or vibrations may increase mechanical wear in cylinder assembly 26, compressor frame 28, and/or fastener assemblies 30. During normal operation, reciprocating compressor 10 generally operates within a predefined range of displacement values, based on structural characteristics of cylinder assembly 26 and compressor frame 28. Over time, as reciprocating compressor 10 is subjected to general mechanical wear, fastener assemblies 30 may become loose and/or structural fatigue may develop within fastener assemblies 30. Such fatigue may cause reciprocating compressor 10 to operate with displacement values that are not within the predefined range of displacement values. In addition, the structural fatigue may reduce a stiffness of reciprocating compressor 10. Condition monitoring system 12 is configured to monitor the stiffness values of reciprocating compressor 10 and to notify an operator when reciprocating compressor 10 is not operating within a predefined range of stiffness values. In one embodiment, condition monitoring system 12 operates motor 46 to modulate a rotational velocity of crankshaft 44 and/or shut-down an operation of reciprocating compressor 10 when a monitored stiffness is different than a predefined stiffness.

In the exemplary embodiment, condition monitoring system 12 includes at lease one vibration sensor 132 that is coupled to cylinder assembly 26 for sensing a displacement of cylinder assembly 26 along centerline axis 68. In the exemplary embodiment, condition monitoring system 12 includes a first vibration sensor 134 and a second vibration sensor 136. First vibration sensor 134 is coupled to cylinder assembly 26 for sensing seismic acceleration of reciprocating compressor 10 and for transmitting a signal indicative of the sensed acceleration to protection system 22. In this embodiment, first vibration sensor 134 senses an acceleration of reciprocating compressor 10 along centerline axis 68. Second vibration sensor 136 is coupled to compressor frame 28 for sensing seismic acceleration of compressor frame 28 and for transmitting a signal indicative of the sensed acceleration to protection system 22. Second vibration sensor 136 senses an acceleration of compressor frame 28 along centerline axis 68.

Figure 3:
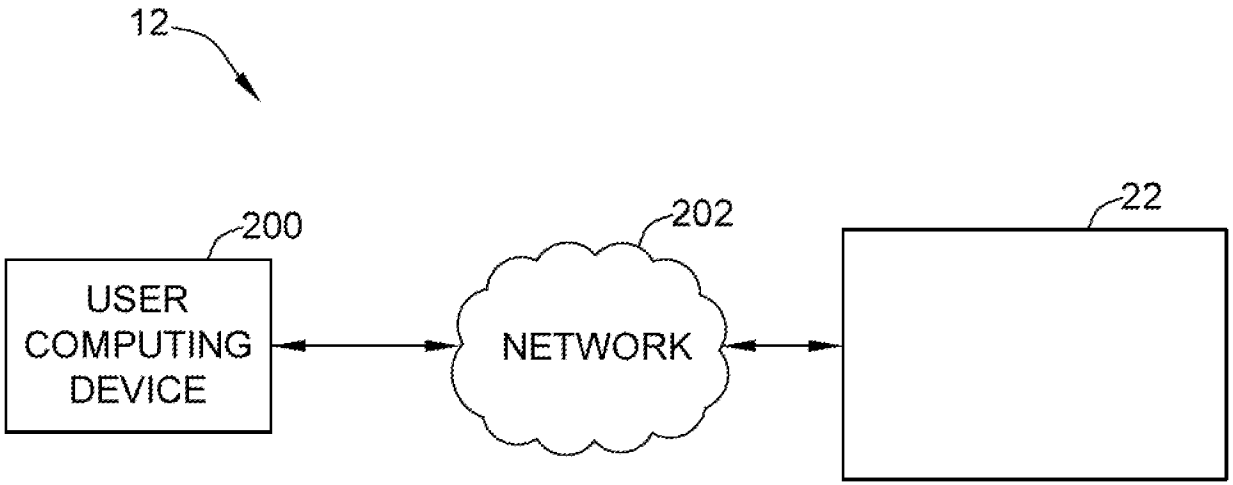
FIG. 3 is a block diagram of an exemplary condition monitoring system that may be used with the reciprocating compressor shown in FIG. 1.

FIG. 3 is a block diagram of condition monitoring system 12. In the exemplary embodiment, condition monitoring system 12 includes a user computing device 200 that is coupled to protection system 22 via a network 202. Network 202 may include, but is not limited to, the Internet, a local area network (LAN), a wide area network (WAN), a wireless LAN (WLAN), a mesh network, and/or a virtual private network (VPN). User computing device 200 and protection system 22 communicate with each other and/or network 202 using a wired network connection (e.g., Ethernet or an optical fiber), a wireless communication means, such as radio frequency (RF), an Institute of Electrical and Electronics Engineers (IEEE) 802.11 standard (e.g., 802.11(g) or 802.11(n)), the Worldwide Interoperability for Microwave Access (WIMAX) standard, a cellular phone technology (e.g., the Global Standard for Mobile communication (GSM)), a satellite communication link, and/or any other suitable communication means. WIMAX is a registered trademark of WiMax Forum, of Beaverton, Oreg. IEEE is a registered trademark of Institute of Electrical and Electronics Engineers, Inc., of New York, N.Y.

Figure 4:
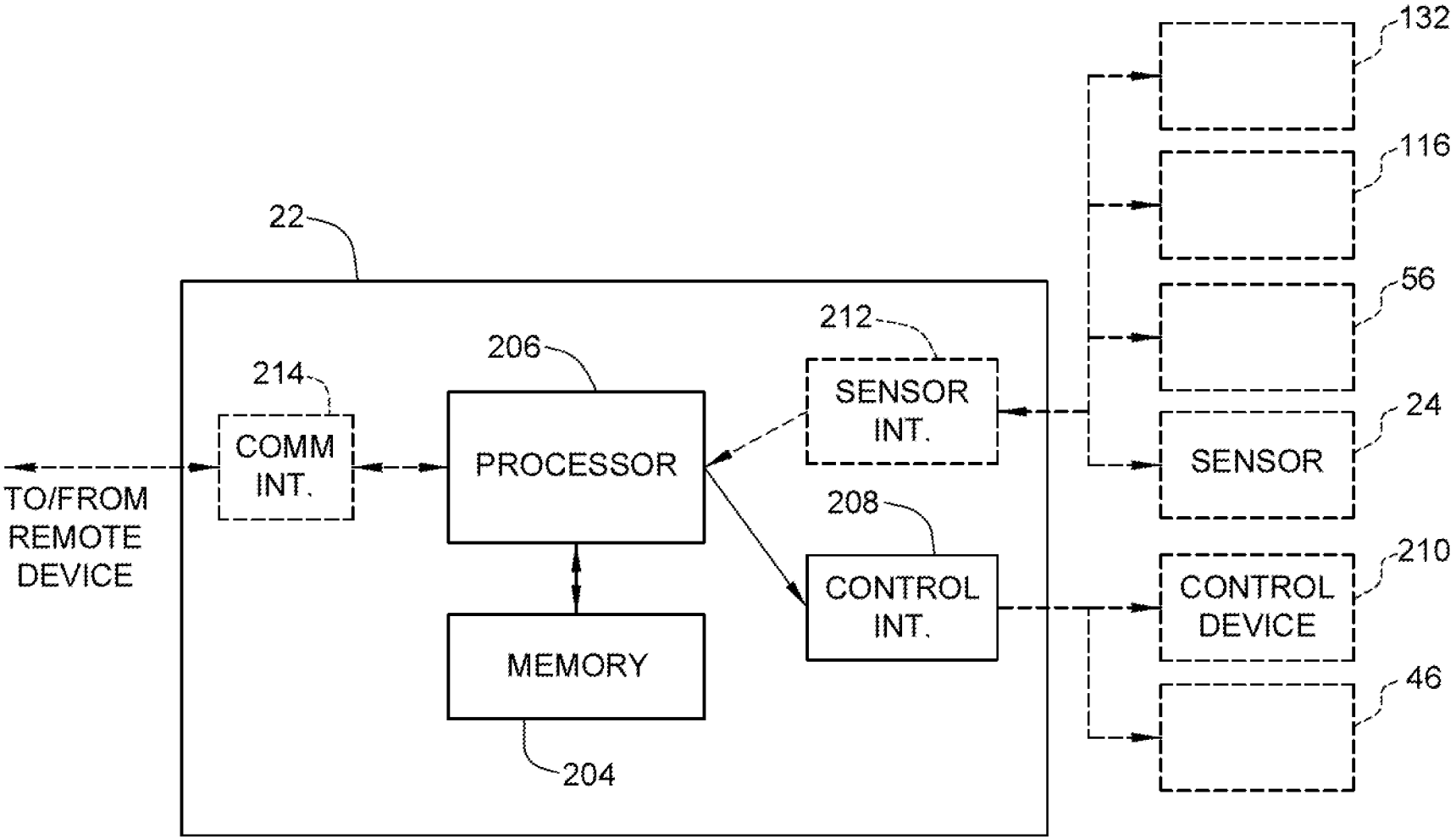
FIG. 4 is a block diagram of an exemplary protection system that may be used with the condition monitoring system shown in FIG. 3.

FIG. 4 is a block diagram of protection system 22. In the exemplary embodiment, protection system 22 is a real-time controller that includes any suitable processor-based or microprocessor-based system, such as a computer system, that includes microcontrollers, reduced instruction set circuits (RISC), application-specific integrated circuits (ASICs), logic circuits, and/or any other circuit or processor that is capable of executing the functions described herein. In one embodiment, protection system 22 may be a microprocessor that includes read-only memory (ROM) and/or random access memory (RAM), such as, for example, a 32 bit microcomputer with 2 Mbit ROM and 64 Kbit RAM. As used herein, the term "real-time" refers to outcomes occurring at a substantially short period of time after a change in the inputs affect the outcome, with the time period being a design parameter that may be selected based on the importance of the outcome and/or the capability of the system processing the inputs to generate the outcome.

In the exemplary embodiment, protection system 22 includes a memory area 204 that stores executable instructions and/or one or more operating parameters representing and/or indicating an operating condition of reciprocating compressor 10. Operating parameters may represent and/or indicate, without limitation, a vibration frequency, a fluid pressure, a rotational position, and/or a displacement. In one embodiment, memory area 204 stores a predefined range of operating stiffness values that are received from user computing device 200. In the exemplary embodiment, protection system 22 also includes a processor 206 that is coupled to memory area 204 and that is programmed to calculate a condition of reciprocating compressor 10 based at least in part on one or more operating parameters. For example, processor 206 also calculates a condition of reciprocating compressor 10 based on the predefined range of operating stiffness values. In one embodiment, processor 206 may include a processing unit, such as, without limitation, an integrated circuit (IC), an application specific integrated circuit (ASIC), a microcomputer, a programmable logic controller (PLC), and/or any other programmable circuit. Alternatively, processor 206 may include multiple processing units (e.g., in a multi-core configuration).

In the exemplary embodiment, processor 206 is programmed to calculate an operating stiffness value of reciprocating compressor 10 based at least in part on a vibration signal that is received from vibration sensor 132 and a pressure signal that is received from pressure sensor 116. Processor 206 also compares the calculated operating stiffness value to the predefined stiffness value to determine if a condition of reciprocating compressor 10 is below the predefined reciprocating compressor 10 condition, if the calculated operating stiffness value is different than the predefined operating stiffness value.

In one embodiment, processor 206 calculates a first range of operating stiffness values of reciprocating compressor 10 during a first complete compressor operation cycle. Such a calculation is based at least in part on a vibration signal received from vibration sensor 132 and a pressure signal received from pressure sensor 116. In this embodiment, processor 206 also calculates a second range of operating stiffness values over a second complete compressor operation cycle based at least in part on vibration signal received from vibration sensor 132 and a pressure signal received from pressure sensor 116. Processor 206 compares the calculated first range of operating stiffness values to the calculated second range operating stiffness values, and to determine that a condition of reciprocating compressor 10 is below the predefined reciprocating compressor 10 condition if the calculated first range of operating stiffness values is different than the calculated second range of operating stiffness values.

In the exemplary embodiment, protection system 22 also includes a control interface 208 that controls an operation of reciprocating compressor 10 based at least in part on a calculated condition of reciprocating compressor 10. In some embodiments, control interface 208 is coupled to one or more reciprocating compressor control devices 210, such as, for example, motor 46 (shown in FIG. 2).

In the exemplary embodiment, protection system 22 includes a sensor interface 212 that is coupled to at least one sensor 24 such as, for example, position sensor 56, pressure sensor 116, and/or vibration sensor 132, for receiving signals from sensor 24. Each sensor 24 transmits a signal corresponding to a sensed operating parameter of reciprocating compressor 10. Moreover, each sensor 24 may transmit a signal continuously, periodically, or only once, for example, although, other signal timings are also contemplated. Furthermore, each sensor 24 may transmit a signal either in an analog form or in a digital form. Protection system 22 processes the signal(s) by processor 206 to create one or more operating parameters. In some embodiments, processor 206 is programmed (e.g., with executable instructions in memory area 204) to sample a signal produced by sensor 24. For example, processor 206 may receive a continuous signal from sensor 24 and, in response, periodically (e.g., once every five seconds) calculate a condition of reciprocating compressor 10 based on the continuous signal. In some embodiments, processor 206 normalizes a signal received from sensor 24. For example, sensor 24 may produce an analog signal with a parameter (e.g., voltage) that is directly proportional to an operating parameter value. Processor 206 may be programmed to convert the analog signal to the operating parameter. In one embodiment, sensor interface 212 includes an analog-to-digital converter that converts an analog voltage signal generated by sensor 24 to a multi-bit digital signal usable by protection system 22.

In the exemplary embodiment, protection system 22 includes a communication interface 214. Communication interface 214 is coupled in communication with one or more remote devices, such as user computing device 200. Communication interface 214 may transmit an operating parameter and/or a control parameter (e.g., a rotational velocity) to a remote device. For example, communication interface 214 may encode an operating parameter and/or a control parameter in a signal. In addition communication interface 214 receives the operating parameter and/or the control parameter from a remote device and control an operation of reciprocating compressor 10 based at least in part on the received operating parameter and/or control parameter.

Various connections are available between control interface 208 and control device 210, and between sensor interface 212 and sensor 24. Such connections may include, without limitation, an electrical conductor, a low-level serial data connection, such as Recommended Standard (RS) 232 or RS-485, a high-level serial data connection, such as Universal Serial Bus (USB) or Institute of Electrical and Electronics Engineers (IEEE) 1394 (a/k/a FIREWIRE), a parallel data connection, such as IEEE 1284 or IEEE 488, a short-range wireless communication channel such as BLUETOOTH, and/or a private (e.g., inaccessible outside reciprocating compressor 10) network connection, whether wired or wireless.

Figure 5:
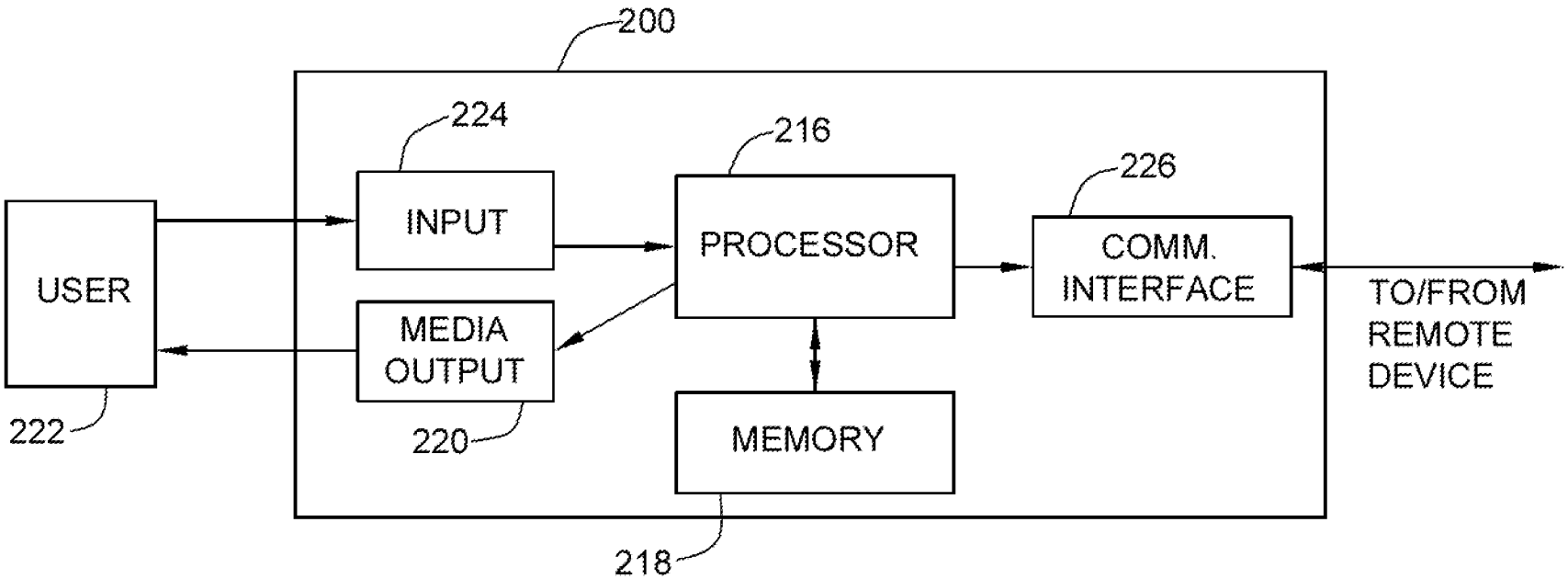
FIG. 5 is a block diagram of an exemplary user computing device that may be used with the condition monitoring system shown in FIG. 3.

FIG. 5 is a block diagram of user computing device 200. In the exemplary embodiment, user computing device 200 includes a processor 216 for executing instructions. In some embodiments, executable instructions are stored in a memory area 218. Processor 216 may include one or more processing units (e.g., in a multi-core configuration). Memory area 218 is any device allowing information, such as executable instructions and/or other data, to be stored and retrieved.

User computing device 200 also includes at least one media output component 220 for use in presenting information to a user 222. Media output component 220 is any component capable of conveying information to user 222. Media output component 220 may include, without limitation, a display device (e.g., a liquid crystal display (LCD), an organic light emitting diode (OLED) display, or an audio output device (e.g., a speaker or headphones).

In some embodiments, user computing device 200 includes an input device 224 for receiving input from user 222. Input device 224 may include, for example, a keyboard, a pointing device, a mouse, a stylus, a touch sensitive panel (e.g., a touch pad or a touch screen), a gyroscope, an accelerometer, a position detector, and/or an audio input device. A single component, such as a touch screen, may function as both an output device of media output component 220 and input device 224. User computing device 200 also includes a communication interface 226, which is communicatively coupled to network 202 and/or protection system 22.

During operation of reciprocating compressor 10, protection system 22 receives signals indicative of a rotational position of crankshaft 44 from position sensor 56. Protection system 22 calculates crank angle $\alpha$ based at least in part the rotational position of crankshaft 44. In the exemplary embodiment, protection system 22 calculates crank angle $\alpha$ at 0.5° intervals. Alternatively, protection system 22 calculates crank angle $\alpha$ at any suitable interval sufficient to enable condition monitoring system 12 to function as described herein.

In the exemplary embodiment, protection system 22 receives signals indicative of a pressure of fluid within cylinder head 92 from pressure sensor 116. Protection system 22 calculates gas force 130 acting upon piston head 58 based at least in part on the received signals from pressure sensor 116. In one embodiment, protection system 22 calculates the gas force acting upon cylinder head 92 by multiplying the sensed pressure by working surface area 84 of piston head 58. In addition, protection system 22 calculates gas force 130 at each calculated crank angle $\alpha$.

In one embodiment, protection system 22 receives signals indicative of a pressure within HE chamber 104 from first pressure sensor 118, and calculates a gas force acting upon head end surface 80 of piston head 58 based at least in part on the received signals from first pressure sensor 118. In addition, protection system 22 receives signals indicative of a pressure within CE chamber 108 from second pressure sensor 120, and calculates a gas force acting upon crank end surface 78 of piston head 58 based at least in part on the received signals from first pressure sensor 118. In this embodiment, protection system 22 calculates gas force 130 by adding the calculated gas force acting upon crank end surface 78 and the gas force acting upon head end surface 80.

In the exemplary embodiment, protection system 22 receives signals indicative of an acceleration of cylinder assembly 26 along centerline axis 68 from vibration sensor 132. Protection system 22 calculates a displacement value of cylinder assembly 26 along centerline axis 68 based at least in part on the sensed acceleration of cylinder assembly 26. In addition, protection system 22 calculates the displacement value of cylinder assembly 26 at each calculated crank angle $\alpha$.

In one embodiment, protection system 22 receives signals indicative of an acceleration of reciprocating compressor 10 along centerline axis 68 from first vibration sensor 134, and receives signals indicative of an acceleration of compressor frame 28 along centerline axis 68 from second vibration sensor 136. Protection system 22 calculates a displacement value of cylinder assembly 26 along centerline axis 68 based at least in part on the sensed acceleration of reciprocating compressor 10 and the sensed acceleration of compressor frame 28. More specifically, protection system 22 calculates the displacement value of cylinder assembly 26 based at least in part on the difference between the sensed acceleration of reciprocating compressor 10 and the sensed acceleration of compressor frame 28. In addition, protection system 22 calculates the displacement value of cylinder assembly 26 at each calculated crank angle $\alpha$.

In the exemplary embodiment, protection system 22 calculates a stiffness value of reciprocating compressor 10 based at least in part on the calculated gas force acting upon cylinder head 92 and the calculated displacement value of cylinder assembly 26 along centerline axis 68. More specifically, protection system 22 calculates the stiffness value of cylinder assembly 26 based at least in part on the ratio of the calculated gas force acting upon cylinder head 92 divided by the calculated displacement value of cylinder assembly 26 along centerline axis 68. In addition, protection system 22 calculates the stiffness value at each calculated crank angle α through a complete compressor operation cycle between crank angle α of 0° and 360°.

In the exemplary embodiment, protection system 22 determines that a condition of reciprocating compressor 10 is less than a predefined reciprocating compressor condition, after determining that the calculated stiffness value of cylinder assembly 26 is different than a predefined stiffness value. Protection system 22 also transmits a notification signal to user computing device 200 after determining that a monitored condition of reciprocating compressor is less than a predefined reciprocating compressor condition. User computing device 200 displays a notification to user 222 with media output component 214 after receiving the notification signal from protection system 22. In one embodiment, protection system 22 operates motor 46 to modulate a rotational velocity of crankshaft 44 after determining that the calculated stiffness value of cylinder assembly 26 is different than a predefined stiffness value. In another alternative embodiment, protection system 22 operates motor 46 to shut-down an operation of reciprocating compressor 10 after determining that the calculated stiffness value of cylinder assembly 26 is different than a predefined stiffness value.

In an alternative embodiment, protection system 22 calculates a first gas force acting upon cylinder head 92 at a calculated first crank angle in a first compressor operation cycle. Protection system 22 also calculates a first displacement value of cylinder assembly 26 at the first calculated crank angle in the first compressor operation cycle. Protection system 22 calculates a first stiffness value of cylinder assembly 26 at the first calculated crank angle in the first compressor operation cycle based at least in part on the calculated first gas force and the calculated first displacement value. Protection system 22 also calculates a second gas force acting upon cylinder head 92 at the calculated first crank angle in a second compressor operation cycle, and calculates a second displacement value of cylinder assembly 26 at the first calculated crank angle in a second compressor operation cycle. Protection system 22 calculates a second stiffness value of cylinder assembly 26 at the first calculated crank angle in the second compressor operation cycle based at least in part on the calculated second gas force and the calculated second displacement value.

In an alternative embodiment, protection system 22 determines that a condition of reciprocating compressor 10 is less than a predefined reciprocating compressor condition after determining that the calculated first stiffness value of cylinder assembly 26 is different than the calculated second stiffness value. Protection system 22 transmits a first notification signal to user computing device 200 after determining that the calculated first stiffness value of cylinder assembly 26 is different than the calculated second stiffness value. Protection system 22 also transmit a second notification signal after determining that the calculated second stiffness value of cylinder assembly 26 is less than a predefined stiffness value.

In one embodiment, protection system 22 calculates a range of gas force values acting upon cylinder head 92 in a first complete compressor operation cycle. Protection system 22 also calculate an array of gas force values based at least in part on the calculated range of gas force values. Protection system 22 calculates a range of displacement values of cylinder assembly 26 in the first complete compressor operation cycle. Protection system 22 also calculates an array of displacement values based at least in part on the calculated range of displacement values. In this embodiment, protection system 22 calculates a stiffness spectra output based at least in part on the calculated array of gas force values and the calculated array of displacement values. Protection system 22 also determines that a condition of reciprocating compressor 10 is less than a predefined reciprocating compressor condition after determining that the calculated stiffness spectra output for reciprocating compressor 10 is different than a predefined stiffness spectra output.

In an alternative embodiment, protection system 22 calculates a first range of stiffness values of cylinder assembly 26 associated with a first complete compressor operation cycle, and to calculate a second range of stiffness values of cylinder assembly 26 associated with a second complete compressor operation cycle. Protection system 22 also calculates a first frequency of stiffness values based at least in part on the calculated first range of stiffness values, and to calculate a second frequency of stiffness values based at least in part on the calculated second range of stiffness values. In this embodiment, protection system 22 determines that a condition of reciprocating compressor 10 is less than a predefined reciprocating compressor condition after determining that the calculated first frequency of stiffness values is different than the calculated second frequency of stiffness values. In one embodiment, protection system 22 calculates the frequency of gas force values and the frequency of displacement values using Fourier transform.

In another alternative embodiment, protection system 22 calculates an array range of gas force values acting upon cylinder head 92 at a plurality of calculated crank angles. Protection system 22 also calculates an array of displacement values of cylinder assembly 26 the plurality of calculated crank angles. In this embodiment, protection system 22 calculate an array of stiffness values within a predefined range of calculated crank angles based at least in part on the calculated array of gas force values divided by the calculated array of displacement values.

Figure 6:
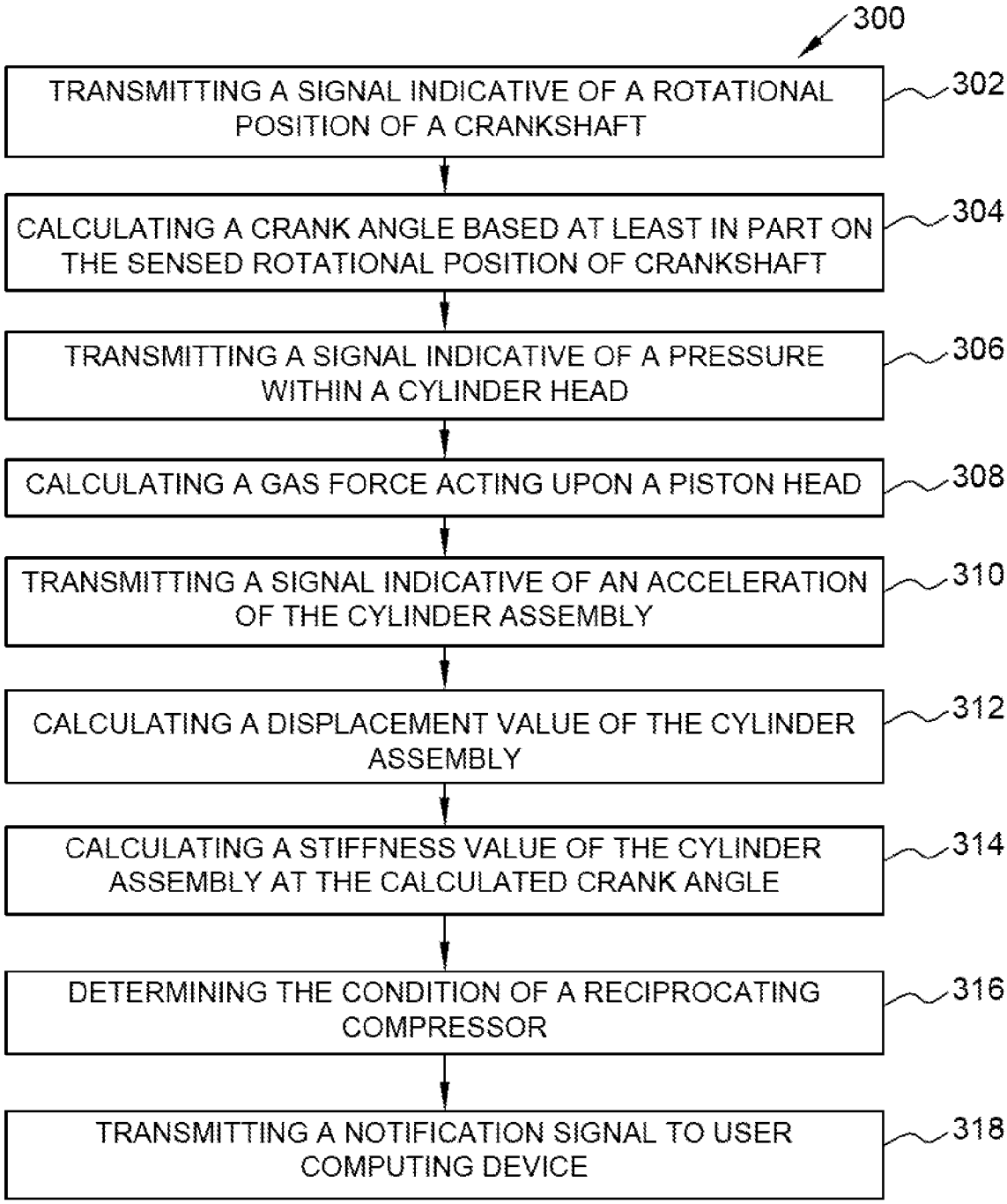
FIG. 6 is a flow chart of an exemplary method that may be used in monitoring the reciprocating compressor shown in FIG. 1.

FIG. 6 is a flow chart illustrating an exemplary method 300 for use in monitoring a condition of the reciprocating compressor shown in FIG. 1. In the exemplary embodiment, method 300 includes transmitting 302, from position sensor 56 to protection system 22, a signal indicative of a rotational position of crankshaft 44. Protection system 22 calculates 304 a crank angle α based at least in part the sensed rotational position of crankshaft 44. Pressure sensor 116 transmits 306 to protection system 22 a signal indicative of a pressure within cylinder head 92. Protection system 22 calculates 308 a gas force acting upon piston head 58 based at least in part on the sensed pressure. In one embodiment, protection system 22 calculates 308 the gas force by multiplying the sensed pressure by the working surface area 84 of piston head 58.

Vibration sensor 132 transmits 310 to protection system 22 a signal indicative of an acceleration of cylinder assembly 26 along centerline axis 68. Protection system 22 calculates 312 a displacement value of cylinder assembly 26 along centerline axis 68 based at least in part on the sensed acceleration of cylinder assembly 26. Protection system 22 calculates 314 a stiffness value of cylinder assembly 26 at the calculated 304 crank angle based at least in part on the calculated 308 gas force and the calculated 312 displacement of cylinder assembly 26. More specifically, protection system 22 calculates 314 the stiffness value of cylinder assembly 26 based at least in part on the calculated 308 gas force divided by the calculated 312 displacement of cylinder assembly 26. Protection system 22 determines 316 the condition of reciprocating compressor 10 is less than a predefined reciprocating compressor condition if the calculated 314 stiffness value is different that a predefined stiffness value. Protection system 22 transmits 318 a notification signal to user computing device 200 after determining 316 that the condition of reciprocating compressor 10 is different than a predefined reciprocating compressor condition.

Figure 7:
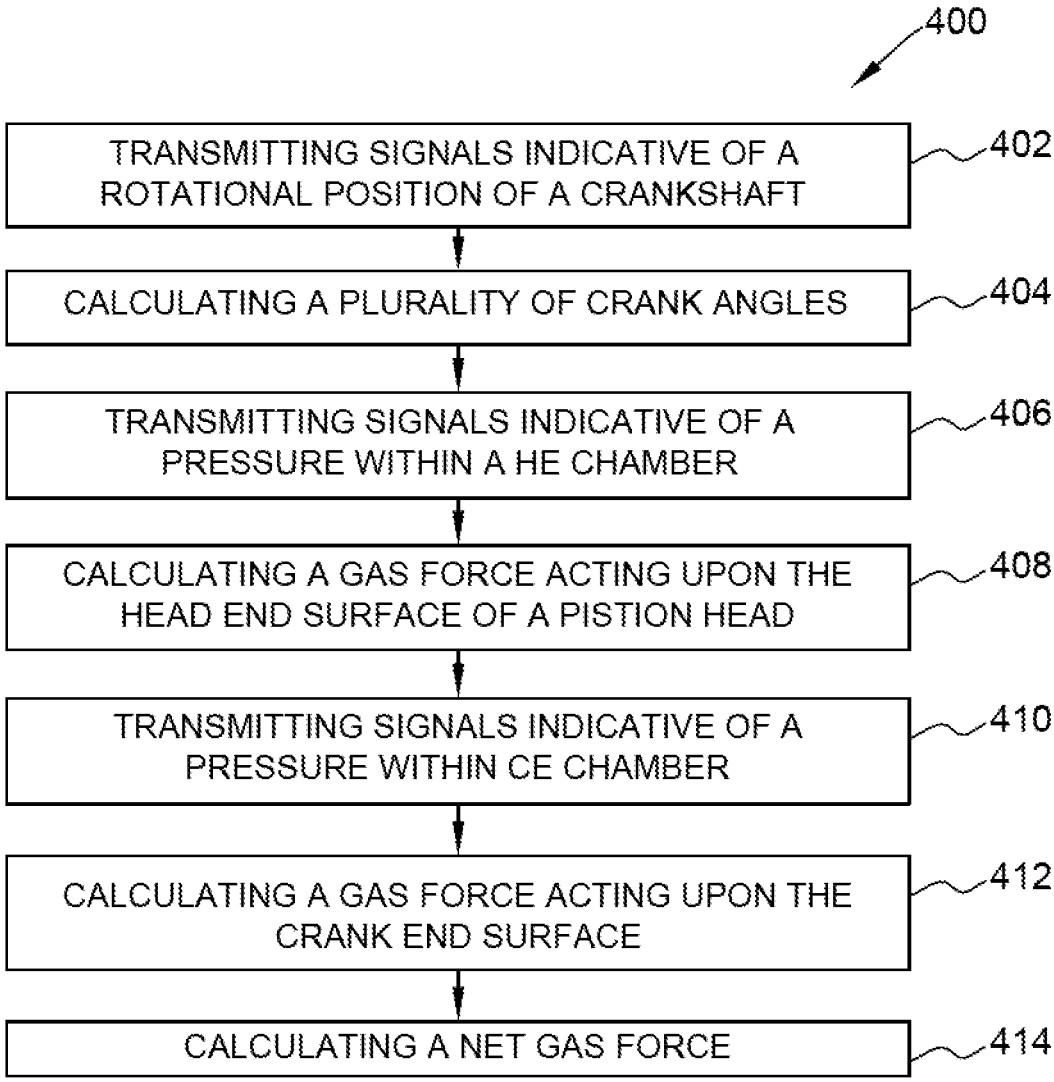
FIGS. 7 and 8 are flow charts of alternative methods that may be used in monitoring the reciprocating compressor shown in FIG. 1.

FIG. 7 is a flow chart illustrating an alternative method 400 that may be used for monitoring a condition of the reciprocating compressor shown in FIG. 1. In an alternative embodiment, method 400 includes transmitting 402, from position sensor 56 to protection system 22, signals indicative of a rotational position of crankshaft 44. Protection system 22 calculates 404 a plurality of crank angles $\alpha$ at each 0.5° interval during a complete compressor operation cycle. First pressure sensor 118 transmits 406 to protection system 22 signals indicative of a pressure within HE chamber 104. Protection system 22 calculates 408 a gas force acting upon head end surface 80 of piston head 58 based at least in part on the signals transmitted 406 from first pressure sensor 118. Second pressure sensor 120 transmits 410 to protection system 22 signals indicative of a pressure within CE chamber 108. Protection system 22 calculates 412 a gas force acting upon crank end surface 78 of piston head 58 based at least in part on the signals transmitted 406 from first pressure sensor 118. Protection system 22 calculates 414 a net gas force 130 by adding the calculated 412 gas force acting upon crank end surface 78 and the calculated 408 gas force acting upon head end surface 80.

First vibration sensor 134 transmits to protection system 22 signals indicative of an acceleration of reciprocating compressor 10 along centerline axis 68. Second vibration sensor 136 transmits to protection system 22 signals indicative of an acceleration of compressor frame 28 along centerline axis 68. Protection system 22 calculates a displacement value of cylinder assembly 26 along centerline axis 68 based at least in part on the difference between the sensed acceleration of reciprocating compressor 10 and the sensed acceleration of compressor frame 28.

Protection system 22 calculates a first stiffness value of cylinder assembly 26 at a calculated first crank angle $\alpha$ in a first compressor operation cycle. Protection system 22 calculates a second stiffness value of cylinder assembly 26 at the calculated first crank angle $\alpha$ in a second compressor operation cycle. Protection system 22 determines whether the calculated first stiffness value of cylinder assembly 26 is different than the calculated second stiffness value and transmits a first notification signal to user computing device 200 after determining that the calculated first stiffness value of cylinder assembly 26 is different than the calculated second stiffness value. Protection system 22 determines whether the calculated second stiffness value is different than a predefined value and transmits a second notification signal after determining that the calculated second stiffness value is less than the predefined stiffness value.

Figure 8:
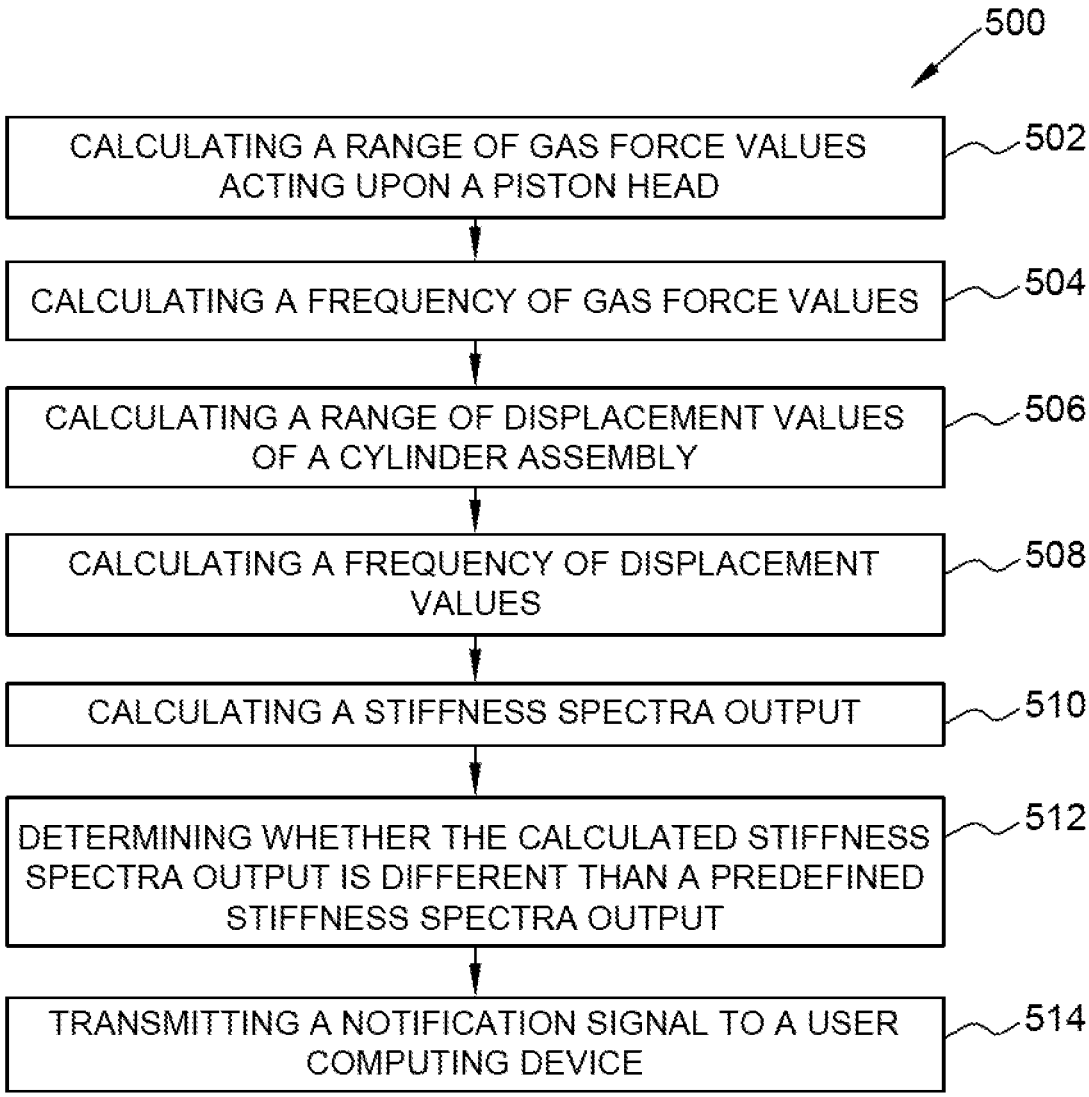

FIG. 8 is a flow chart illustrating an alternative method 500 that may be used for monitoring a condition of the reciprocating compressor shown in FIG. 1. In an alternative embodiment, method 500 includes calculating 502, by protection system 22, a range of gas force values acting upon piston head 58 at each crank angle $\alpha$ in a first compression operation. Protection system 22 calculates 504 a frequency of gas force values based at least in part on the calculated 502 range of gas force values. Protection system 22 calculates 506 a range of displacement values of cylinder assembly 26 at each crank angle $\alpha$ in the first compression operation. Protection system 22 calculates 508 a frequency of displacement values based at least on part on the calculated 506 range of displacement values. Protection system 22 calculates 510 a stiffness spectra output based at least in part on the calculated 504 frequency of gas force values divided by the calculated 508 frequency of displacement values.

Protection system 22 determines 512 whether the calculated 510 stiffness spectra output is different that a predefined stiffness spectra output, and transmits 514 a notification signal to user computing device 200 after determining 512 that the calculated 510 stiffness spectra output is less than a predefined stiffness spectra output.

The above-described systems and methods overcome disadvantages of known monitoring systems by providing a condition monitoring system that facilitates monitoring the stiffness of reciprocating compressors during operation of the reciprocating compressors. More specifically, the condition monitoring system facilitates monitoring a stiffness of a cylinder assembly and determining the condition of the reciprocating compressor based on the calculated stiffness. Further, the system described herein operates the reciprocating compressor to shut-down after determining that the stiffness of the reciprocating compressor is different than a predefined reciprocating compressor stiffness. As such, the damage that can occur to a reciprocating compressor during operation is facilitated to be reduced or eliminated, thereby extending the operational life of a reciprocating compressor.

An exemplary technical effect of the methods, system, and apparatus described herein includes at least one of: (a) transmitting, from a first sensor to a protection system, a first monitoring signal indicative of a pressure within the cylinder assembly of the reciprocating compressor; (b) transmitting, from at least a second sensor to the protection system, at least a second monitoring signal indicative of an acceleration of the cylinder assembly; (c) calculating, by the protection system, a stiffness value of the reciprocating compressor based at least in part on the first signal and the second signal; (d) transmitting a notification signal from the protection system to a user computing device after determining that the calculated stiffness value is different than a predefined stiffness value; (e) calculating a gas force value based at least in part on the sensed pressure within the cylinder assembly; (f) calculating a displacement value of the cylinder assembly based at least in part on the sensed acceleration of the cylinder assembly; and (g) calculating a stiffness value of the reciprocating compressor based at least in part on the calculated gas force and the calculated displacement of the cylinder assembly.

Exemplary embodiments of systems and methods for monitoring a condition of a reciprocating compressor are described above in detail. The systems and methods are not limited to the specific embodiments described herein, but rather, components of the systems and/or steps of the methods may be utilized independently and separately from other components and/or steps described herein. For example, the methods may also be used in combination with reciprocating compressor monitoring systems, and are not limited to practice with only the reciprocating compressor systems as described herein. Rather, the exemplary embodiment can be implemented and utilized in connection with many other reciprocating compressor monitoring applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A condition monitoring system for use with a reciprocating device, the condition monitoring system comprising:

at least one pressure sensor configured to sense a pressure within the reciprocating device;

at least one vibration sensor configured to sense a vibration of the reciprocating device; and a protection system communicatively coupled to the pressure sensor and the vibration sensor, the protection system configured to calculate a stiffness value of the reciprocating device based on the sensed pressure within the reciprocating device and the sensed vibration of the reciprocating device.

2. The condition monitoring system in accordance with claim 1, further comprising a user computing device communicatively coupled to the protection system, the protection system configured to transmit a notification signal to the user computing device after determining that the calculated stiffness value is different than a predefined reciprocating device stiffness value.

3. The condition monitoring system in accordance with claim 1, wherein the protection system is configured to:

calculate a gas force based at least in part on the sensed pressure within the reciprocating device;

calculate a displacement value of the reciprocating device based at least in part on the sensed vibration of the reciprocating device; and calculate the stiffness value based at least in part on the calculated gas force divided by the calculated displacement value.

4. The condition monitoring system in accordance with claim 3, wherein the reciprocating device comprises a crank shaft, the condition monitoring system further comprises at least one position sensor configured to sense a position of the crank shaft, the protection system communicatively coupled to the position sensor and configured to calculate a crank angle of the crank shaft based at least in part on the sensed position.

5. The condition monitoring system in accordance with claim 4, wherein the protection system is configured to:

calculate a stiffness value at a crank angle; and transmit a notification signal to a user computing device after determining that the calculated stiffness value is different than a predefined stiffness value.

6. The condition monitoring system in accordance with claim 1, wherein the reciprocating device includes a cylinder assembly coupled to a frame, the condition monitoring system further comprises:

a first vibration sensor coupled to the cylinder assembly and configured to sense a vibration of the reciprocating device; and a second vibration sensor coupled to the frame and configured to sense a vibration of the frame, the protection system configured to calculate a displacement value of the cylinder assembly based at least in part on the sensed vibration of the reciprocating device and the sensed vibration of the frame.

7. The condition monitoring system in accordance with claim 4, wherein the protection system is configured to:

calculate an array of gas force values at a plurality of calculated crank angles;

calculate an array of displacement values at the plurality of calculated crank angles; and calculate an array of stiffness values within a predefined range of calculated crank angles based at least in part on the calculated array of gas force values divided by the calculated array of displacement values.

8. The condition monitoring system in accordance with claim 7, wherein the protection system is configured to:

calculate a stiffness spectra output based at least in part on the calculated array of gas force values divided by the calculated array of displacement values; and transmit a notification signal to a user computing device after determining that the calculated stiffness spectra output is different than a predefined spectra stiffness output.

9. A reciprocating compressor comprising:

a compressor frame;

a crank shaft positioned within the compressor frame;

a cylinder assembly coupled to the compressor frame and to the crank shaft, the cylinder assembly extending outwardly from the compressor frame along a centerline axis;

at least one pressure sensor configured to sense a pressure within the reciprocating compressor;

at least one vibration sensor configured to sense a vibration of the reciprocating compressor; and a protection system communicatively coupled to the pressure sensor and the vibration sensor, the protection system configured to calculate a stiffness value of the reciprocating compressor based on the sensed pressure within the reciprocating compressor and the sensed vibration of the reciprocating compressor.

10. The reciprocating compressor in accordance with claim 9, further comprising a user computing device communicatively coupled to the protection system, the protection system configured to transmit a notification signal to the user computing device after determining that the calculated stiffness value is different than a predefined reciprocating compressor stiffness value.

11. The reciprocating compressor in accordance with claim 9, wherein the protection system is configured to:

calculate a gas force based at least in part on the sensed pressure within the cylinder assembly;

calculate a displacement value of the reciprocating compressor based at least in part on the sensed vibration of the reciprocating compressor; and calculate the stiffness value based at least in part on the calculated gas force divided by the calculated displacement value.

12. The reciprocating compressor in accordance with claim 11, further comprising at least one position sensor configured to sense a position of the crank shaft, the protection system communicatively coupled to the position sensor and configured to calculate a crank angle of the crank shaft based at least in part on the sensed position.

13. The reciprocating compressor in accordance with claim 12, wherein the protection system is configured to:

calculate a stiffness value at a crank angle; and transmit a notification signal to a user computing device after determining that the calculated stiffness value is different than a predefined stiffness value.

14. The reciprocating compressor in accordance with claim 9, further comprising:

a first vibration sensor coupled to the cylinder assembly and configured to sense a vibration of the reciprocating compressor; and a second vibration sensor coupled to the compressor frame and configured to sense a vibration of the compressor frame, the protection system configured to calculate a displacement value of the cylinder assembly based at least in part on the sensed vibration of the reciprocating compressor and the sensed vibration of the compressor frame.

15. The reciprocating compressor in accordance with claim 12, wherein the protection system is configured to:

calculate an array of gas force values;

calculate an array of displacement values;

calculate a stiffness spectra output based at least in part on the calculated array of gas force values divided by the calculated array of displacement values; and transmit a notification signal to a user computing device after determining that the calculated stiffness spectra output is different than a predefined spectra stiffness output.

16. A method for monitoring a condition of a reciprocating compressor, the reciprocating compressor includes a cylinder assembly coupled to a frame, the method comprising:

transmitting, from a first sensor to a protection system, a first monitoring signal indicative of a pressure within the cylinder assembly of the reciprocating compressor;

transmitting, from at least a second sensor to the protection system, at least a second monitoring signal indicative of a vibration of the cylinder assembly; and calculating, by the protection system, a stiffness value of the reciprocating compressor based at least in part on the first signal and the second signal, wherein the protection system is communicatively coupled to the first and second sensors.

17. The method in accordance with claim 16, further comprising transmitting a notification signal from the protection system to a user computing device after determining that the calculated stiffness value is different than a predefined stiffness value.

18. The method in accordance with claim 16, further comprising:

calculating a gas force value based at least in part on the sensed pressure within the cylinder assembly;

calculating a displacement value of the cylinder assembly based at least in part on the sensed vibration of the cylinder assembly; and calculating a stiffness value of the reciprocating compressor based at least in part on the calculated gas force and the calculated displacement of the cylinder assembly.

19. The method in accordance with claim 16, wherein the reciprocating compressor includes a crank shaft rotatably coupled to a piston assembly, the method further comprising:

transmitting, from a third sensor to the protection system, a third monitoring signal indicative of a rotational position of the crank shaft;

calculating, by the protection system, a crank angle of the crank shaft based at least in part on the third monitoring signal;

calculating a first stiffness value at a calculated first crank angle in a first operating cycle;

calculating a second stiffness value at the calculated first crank angle in a second operating cycle;

transmitting a first notification signal from the protection system to a user computing device after determining that the calculated first stiffness value is different than the calculated second stiffness value; and transmit a second notification signal from the protection system to the user computing device after determining that the calculated second stiffness value is less than a predefined stiffness value.

20. The method in accordance with claim 18, further comprising:

calculating a frequency of gas force values based at least in part on the calculated gas force value;

calculating a frequency of displacement values based at least in part on the calculated displacement value;

calculating a stiffness spectra output based at least in part on the calculated frequency of gas force values divided by the calculated frequency of displacement values; and transmitting a notification signal from the protection system to the user computing device after determining that the calculated stiffness spectra output is different than a predefined spectra stiffness output.

* * * * *